US008114822B2

(12) United States Patent
Costello et al.

(10) Patent No.: US 8,114,822 B2
(45) Date of Patent: Feb. 14, 2012

(54) SOLUBLE OIL CONTAINING OVERBASED SULFONATE ADDITIVES

(75) Inventors: Michael T. Costello, Southington, CT (US); Igor Riff, Skillman, NJ (US)

(73) Assignee: Chemtura Corporation, Middlebury, CT (US)

( * ) Notice: Subject to any disclaimer, the term of this patent is extended or adjusted under 35 U.S.C. 154(b) by 1106 days.

(21) Appl. No.: 11/586,195

(22) Filed: Oct. 24, 2006

(65) Prior Publication Data

US 2008/0096777 A1 Apr. 24, 2008

(51) Int. Cl.

| | |
|---|---|
| ***C10M 159/24*** | (2006.01) |
| ***C10M 163/00*** | (2006.01) |
| ***C10M 159/20*** | (2006.01) |
| ***C10M 101/04*** | (2006.01) |

(52) U.S. Cl. ..... 508/391; 508/398; 508/459; 508/486

(58) Field of Classification Search ..... 508/391, 508/398, 208, 459, 460, 486, 561, 322
See application file for complete search history.

(56) References Cited

U.S. PATENT DOCUMENTS

| | | | | |
|---|---|---|---|---|
| 2,307,744 | A | 1/1943 | Liberthson | |
| 2,470,913 | A | 5/1949 | Bjorksten et al. | |
| 2,670,310 | A | 2/1954 | Freeman | |
| 2,670,318 | A | 2/1954 | Halamka et al. | |
| 2,695,272 | A | 11/1954 | King et al. | |
| 2,846,393 | A | 8/1958 | Cook et al. | |
| 2,913,410 | A | 11/1959 | Fisher | |
| 3,311,561 | A | 3/1967 | Anderson et al. | |
| 3,749,560 | A | 7/1973 | Perilstein et al. | |
| 3,759,828 | A * | 9/1973 | Harrison | 508/248 |
| 3,763,244 | A | 10/1973 | Shubkin | |
| 3,780,128 | A | 12/1973 | Shubkin | |
| 3,981,808 | A | 9/1976 | McClaflin et al. | |
| 4,129,589 | A | 12/1978 | Eliades et al. | |
| 4,172,855 | A | 10/1979 | Shubkin | |
| 4,218,330 | A | 8/1980 | Shubkin | |
| 4,228,021 | A | 10/1980 | Lenack | |
| 4,306,983 | A | 12/1981 | Allain et al. | |
| 4,347,147 | A | 8/1982 | Allain et al. | |
| 4,582,543 | A | 4/1986 | Bretz | |
| 4,597,880 | A | 7/1986 | Eliades | |
| 4,617,135 | A | 10/1986 | Muir | |
| 4,708,753 | A | 11/1987 | Forsberg | |
| 4,778,614 | A | 10/1988 | Rawlinson et al. | |
| 4,844,756 | A | 7/1989 | Forsberg | |
| 4,902,846 | A | 2/1990 | DiLeo et al. | |
| 4,906,798 | A | 3/1990 | Lin | |
| 4,910,355 | A | 3/1990 | Shubkin et al. | |
| 4,911,758 | A | 3/1990 | Lin et al. | |
| 4,935,570 | A | 6/1990 | Nelson et al. | |
| 4,950,822 | A | 8/1990 | Dileo et al. | |
| 4,956,513 | A | 9/1990 | Walker et al. | |
| 4,981,578 | A | 1/1991 | Tycer et al. | |
| 5,259,966 | A | 11/1993 | Burke, Jr. et al. | |
| 5,439,602 | A | 8/1995 | Eckard et al. | |
| 5,484,542 | A | 1/1996 | Cahoon et al. | |
| 5,505,867 | A * | 4/1996 | Ritter | 508/400 |
| 5,716,917 | A | 2/1998 | Williams et al. | |
| 5,888,944 | A | 3/1999 | Patel | |
| 6,153,564 | A | 11/2000 | Arunasalam et al. | |
| 6,211,123 | B1 | 4/2001 | Brown et al. | |
| 6,218,342 | B1 | 4/2001 | Patel | |
| 6,280,485 | B1 | 8/2001 | Daly et al. | |
| 6,444,625 | B1 | 9/2002 | Muir et al. | |
| 6,541,429 | B2 | 4/2003 | McConnachie et al. | |
| 6,573,223 | B1 | 6/2003 | Vinci | |
| 6,648,929 | B1 | 11/2003 | Daly et al. | |
| 6,743,757 | B2 | 6/2004 | Bell et al. | |
| 6,774,165 | B1 | 8/2004 | Clark et al. | |
| 6,790,811 | B2 | 9/2004 | Patel | |
| 6,858,046 | B2 | 2/2005 | Daly et al. | |
| 6,953,771 | B2 | 10/2005 | McConnachie et al. | |
| 2005/0124510 | A1 * | 6/2005 | Costello et al. | 508/306 |

FOREIGN PATENT DOCUMENTS

| | | |
|---|---|---|
| EP | 0 512 425 A1 | 11/1992 |
| EP | 1 010 460 | 6/2000 |
| GB | 778468 | 7/1957 |
| JP | 9-40988 | 2/1997 |
| JP | 09-151389 | 10/1997 |
| WO | WO 93/04150 | 3/1993 |
| WO | WO 2004/106475 A1 | 12/2004 |

* cited by examiner

*Primary Examiner* — Walter D Griffin
*Assistant Examiner* — Vishal Vasisth
(74) *Attorney, Agent, or Firm* — Joseph Suhadolnik

(57) ABSTRACT

The present invention is directed to a soluble oil composition capable of forming stable emulsions exhibiting superior performance and possessing excellent utility as cutting oil for machines. The composition comprises an overbased alkaline earth metal sulfonate possessing anti-wear properties.

14 Claims, No Drawings

SOLUBLE OIL CONTAINING OVERBASED SULFONATE ADDITIVES

FIELD OF THE INVENTION

This invention relates to soluble oil and more particularly to a soluble oil containing overbased sulfonate possessing anti-wear properties which is capable of forming extremely stable emulsions with water.

BACKGROUND OF THE INVENTION

Environmental considerations in Europe, Canada and the United States regarding the use less hazardous materials in industrial oils has obviated the need to find replacements for chlorinated paraffins (CP). Cutting fluids containing chlorine-based extreme pressure agents have been criticized as responsible for corrosion and damage of incinerators caused by environmental pollution and emission of chlorine gases, as well as the generation of dioxin during incineration of waste.

Generally speaking, in metal working processes such as cutting and grinding, chlorine-based extreme pressure agents have been used because of their excellent ability to improve cutting performance and relatively low cost.

Moreover, chlorinated paraffins, a class of chlorine-based extreme pressure agents, raise some concern about their toxicity and carcinogenicity.

As such, soluble oil emulsions with extreme pressure agents absent chlorinated paraffins are preferred. However, the ability to provide soluble oil emulsions containing overbased products has been hampered by incompatibilities of the overbased material and the soluble oil. In general, overbased materials provide hazy soluble oil base and cause phase separation and/or sediment in the final emulsion.

There are numerous references in the literature describing soluble oil formulations for forming stable emulsions with water, see e.g., U.S. Pat. Nos. 2,307,744; 2,470,913; 2,670,310; 2,695,272; 2,846,393; and 2,913,410. The compositions described in these prior art patents generally include mineral oil and an emulsifier package comprising an emulsifier, a coupling agent, and various additives. While these prior art compositions have been quite satisfactory in many instances, there has nevertheless been a continuing need for an oil soluble concentrate capable of forming a stable emulsion, particularly for use as cutting oil in machines.

There remains a need in the art for environmentally friendly stable cutting oil emulsions with improved cutting performance.

SUMMARY OF THE INVENTION

The present invention provides a soluble oil composition which comprises:

a) a base oil;
b) an emulsion stabilizing amount of a neutralized carboxylic acid;
c) at least one overbased alkaline earth metal sulfonate; and, optionally,
d) at least one additive selected from the group consisting of extreme pressure agent, anti-wear agent, emulsifying agent, rust preventive, corrosion inhibitor, anti-foaming agent, anti-oxidant additives, surface active agents, friction modifier and stabilizing agents.

The present invention provides a soluble oil compositions containing overbased sulfonates possessing anti-wear properties which forms stable emulsions with water, without causing phase separation or sediment.

DETAILED DESCRIPTION OF THE INVENTION

Compositions of the type described herein are generally referred to as soluble oils, although these compositions ordinarily form an emulsion when mixed with water. In order to distinguish between the soluble oil and the emulsion which is produced when the soluble oil is mixed with sufficient quantities of water, the term "soluble oil" will be used to describe the oil plus emulsifier, and the emulsion which is formed when the soluble oil is mixed with water will be referred to as a "soluble oil emulsion." The emulsion which is formed when the soluble oil is mixed with water is of the oil-in-water type wherein the aqueous phase constitutes the continuous phase and the mineral oil constituent is the dispersed phase. The soluble oil emulsion allows the good cooling properties of water to be utilized in the metal working process whilst the oil and additives provide lubrication and corrosion inhibiting properties.

Generally, the friction modifiers, antiwear or extreme pressure additives in lubricants, e.g., cutting oils, reduce damage by maintaining a layer of lubricant between moving parts and help reduce harmful metal on metal contact.

Anti-wear, extreme pressure, anti-corrosion, and friction modifiers; as well as detergents and dispersants, are all polar additives which have an affinity to metal surfaces and can compete for the active metal surface site, or interact with each other. In particular, polar and acidic additives tend to destabilize overbased calcium sulfonate, a colloidal dispersion of calcium carbonate in oil, and cause precipitation of the calcium carbonate. The exact mechanism is still poorly understood, but additives like fatty acids, fatty acid esters, amines are very problematic unless they are added in strict proportions as outlined herein.

The base oil of the present invention typically is a 100 Saybolt Univeral Second (SUS) naphthenic oil useful for metalworking, however, any group I, II, or III oils could be used with a viscosity between 70 and 1000 SUS. The base oil not only can be hydrocarbon oils of lubricating viscosity derived from petroleum (or tar sands, coal, shale, etc.), but also can be natural oils of suitable viscosities such as rapeseed oil, etc., and synthetic oils such as hydrogenated polyolefin oils; poly-alpha-olefins (e.g., hydrogenated or unhydrogenated .alpha.-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing.

As is noted above, the base oil can comprise a portion of one or more synthetic oils. Among the suitable synthetic oils are homo- and inter-polymers of $C_2$-$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$-$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls). Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl poly-isopropylene glycol ether having an average molecular weight of 1000, diphenyl ether of polyethylene glycol having a molecular weight of 500-1000, diethyl ether of polypropylene glycol having a molecular weight of 1000-1500) or mono- and poly-carboxylic esters thereof, for example, the acetic acid ester, mixed $C_3$-$C_6$ fatty acid esters, or the $C_{13}$ Oxo aciddiester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl)adipate, didodecyl adipate, di(tridecyl)adipate, di(2-ethylhexyl)sebacate, dilauryl sebacate, di-n-hexyl fumarate, dioctyl sebacate, diisooctyl azelate, diisodecyl azelate, dioctyl phthalate, didecyl phthalate, di(eicosyl)sebacate, the 2-ethylhexyl diester of linoleic acid dimer, and the complex ester formed by reacting one mole of sebacic acid with two moles of tetraethylene glycol and two moles of 2-ethylhexanoic acid.

Other esters which may be used include those made from $C_3$-$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$-$C_{14}$ dicarboxylic acid and one or more aliphatic dihydric $C_3$-$C_{12}$ alcohols such as derived from azelaic acid or sebacic acid and 2,2,4-trimeth-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl)silicate, tetra-tert-butylphenyl)silicate, poly(methyl)siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$-$C_{16}$ alpha-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578, the content all of which are incorporated herein by reference. Blends of such materials can also be used in order to adjust the viscometrics of the given base oil. As is well known in the art, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

The soluble oil composition of the present invention may be used in cutting oils emulsified in water by means of a suitable emulsifier. Any conventional emulsifier may be used although according to one specific embodiment of the invention, the preferred emulsifier is a neutralized carboxylic acid compound. According to another specific embodiment of the invention the preferred emulsifier is a neutralized tall oil fatty acid.

Carboxylic acids can be derived from saponification of either animal or vegetable oils or can be synthesized by a variety of methods from petroleum oil based feedstocks.

One prevalent source for carboxylic acids is tall oil and its components (i.e., tall oil fatty acids, tall oil fatty acids<2% rosin and tall oil rosin). Tall oil is a byproduct of the Kraft paper making process. Carboxylic acids are also obtained from vegetable oils, such as, for example, babassu oil, coconut oil, palm oil, corn oil, cotton seed oil, ground nut oil, olive oil, safflower oil, sesame oil, sunflower oil, linseed oil, soybean oil, rapeseed oil, low erucic (or canola oil) rapeseed oil, high erucic oiticica oil, tung oil, castor oil, and the like. Animal source of carboxylic acid include, but are not limited to, butterfat, lard, tallow (beef), tallow (sheep), and the like. They can also be obtained from marine oils, e.g., herring oil, menhaden oil, sardine oil, whale oil, and the like. The carboxylic acids described herein can be neutralized with NaOH or any other suitable alkali base.

Useful fatty acids of the present invention include but are not limited to rosin acids and fatty acids present in tall oil and other naturally occurring products. Some specific saturated acids include caproic, caprylic, lauric, myristic, palmitic, stearic, arachidic, behenic, lignoceric, heptadecanoic, and nonadecanoic. Unsaturated acids such as, palmitoleic, oleic, ricinoleic, linoleic, linolenic, eleostearic, gadoleic, erucic, and eicosadienoic.

In one embodiment of the invention, the amount of neutralized carboxylic acid ranges from 0 to about 30 weight percent of the soluble oil composition. In another embodiment, the amount of neutralized carboxylic acid ranges from about 5 to about 23 weight percent of the soluble oil composition. In still another embodiment of the invention the amount of neutralized carboxylic acid ranges from about 12 to 15 weight percent of the soluble oil composition.

In one specific embodiment of the invention, the emulsifier used in the soluble oil composition is a neutralized tall oil. Tall oil is a resinous oily liquid composed of a mixture of rosin acids and fatty acids obtained as a byproduct in the treatment of pine pulp and used in soaps, emulsions, and lubricants. Tall oil can contain from 0-50% resin acids (rosin) and from 0-50% fatty acids. Abietic and dehydroabietic acids comprise over 60% of the resin acids, while oleic and linoleic acids predominate in the fatty acid fraction. Common tall oil blends typically contain 30% rosin acids and 70% tall oil fatty acids. The tall oil and/or its components can be neutralized with NaOH or any other suitable alkali base to obtain neutralized tall oil.

In one embodiment of the invention, the amount of neutralized tall oil ranges from 0 to about 30 weight percent of the soluble oil composition. In another embodiment, the amount of neutralized tall oil ranges from about 5 to about 23 weight percent of the soluble oil composition. In still another embodiment of the invention the amount of neutralized tall oil ranges from about 12 to 15 weight percent of the soluble oil composition.

The sulfurized overbased compounds of the present invention are thermally stable and are useful as extreme pressure (EP) and/or anti-wear agents or antioxidants for use in lubricants, functional fluids and soluble oil. The sulfurized overbased products are particularly suitable for use as EP and/or anti-wear agents for use in cutting fluids.

Overbased sulfonates are metallic salts of sulfonic acid compounds and are well known in the art. Overbased sulfonates are characterized by a metal content in excess of that which would be present according to the stoichiometry of the metal and the acidic organic compound reacted with the metal. The "overbased" metal content of an overbased sulfonate typically may be suspended or complexed with the petroleum sulfonate. (Kirk-Othmer Encyclopedia of Chemical Technology, John Wiley & Sons, Third Edition, N.Y. (1979), vol. 22, page 23).

The most widely-used overbased alkaline-earth sulfonates are based on calcium, magnesium, and barium. (Kirk-Othmer, supra., vol 22, page 23). Overbased calcium sulfonates, for example, might include CaO, $Ca(OH)_2$, or $CaCO_3$ suspended or complexed with the sulfonate.

Methods of manufacturing overbased sulfonates are described in various patents, including: Eliades et al., U.S. Pat. No. 4,129,589; Allain et al., U.S. Pat. No. 4,306,983; Allain et al., U.S. Pat. No. 4,347,147; Eliades et al., U.S. Pat. No. 4,597,880; Muir, U.S. Pat. No. 4,617,135; and Burke, Jr. et al., U.S. Pat. No. 5,259,966, the contents all of which are incorporated herein by reference.

As such, overbased alkaline earth sulfonates are compounds prepared by neutralizing a sulfonic acid with an excess of alkaline earth metal base (e.g., the hydroxides of magnesium, calcium or barium) so as to produce an overbased alkaline earth metal sulfonate with a total base number ("TBN") of greater than zero. The TBN is the amount of acid needed to neutralize all of the alkalinity of the overbased material, and can be determined according to ASTM D 2896. A composition with a TBN of about 100 or less is considered to be a "low overbased material." A TBN of about 100 to 300 is characterized as "moderate overbasing." A composition with a TBN of over 300 is considered to be a "highly overbased" material. According to one embodiment of the invention, the overbased alkaline earth metal sulfonate is overbased calcium sulfonate having a TBN of above about 250, and according to another embodiment above about 350, and in yet another embodiment, above about 400 or higher.

According to another aspect of the invention it has been found that amorphous overbased calcium sulfonate is superior to crystalline overbased calcium sulfonate in terms of undesired sedimentation. An amorphous overbased calcium sulfonate suitable for use in the present inventor in commercially available from Chemtura Corporation of Middlebury Conn. under the designation Calcinate™ C-400 CLR. The amorphous overbased calcium sulfonate has a particle size of less than about 30 nm. Crystalline overbased calcium sulfonates have a particle size above 30 nm, preferably 50-500 nm and more preferably 50-100 nm. Calcinate™ C-300CS, available from Chemtura Corporation, is an example of a crystalline overbased calcium sulfonate. A method for preparing highly overbased calcium sulfonate is described in U.S. Pat. No. 6,444,625 B1, which is herein incorporated by reference.

In one embodiment of the invention, the amount of overbased alkaline earth metal sulfonate ranges from about 0.1 to about 20 weight percent of the soluble oil composition. In another embodiment, the amount of overbased alkaline earth metal sulfonate ranges from about 1 to about 10 weight percent of the soluble oil composition. In still another embodiment of the invention overbased alkaline earth metal sulfonate ranges from about 2 to 5 about weight percent of the soluble oil composition.

According to one aspect of the invention, it has been found that certain extreme pressure agents, anti-wear agents and/or friction modifiers, when combined with an overbased alkaline earth sulfonate, provide for improved performance properties.

In one specific embodiment of the present invention, the soluble oil composition employs a sulfurized olefin anti-wear agent along with the overbased alkaline earth sulfonate.

Friction modifiers are used to reduce the coefficient of friction. In this regard, the friction modifier and/or anti-wear agent and overbased calcium sulfonate can be combined and packaged with other additives such as antioxidants, dispersants and/or defoamers, or other types of additives such as mentioned above.

Various friction modifiers can be used in the additive mixture. Such friction modifiers include glycerol monoesters, overbased carboxylates, overbased tall oil fatty acids, the reaction product of an alkanolamine (e.g., triethanolamine ("TEA") or diethanolamine) or a glycol (e.g., thiodiglycol, diethylene glycol) with a fatty acid or fatty ester, oxygenated petroleum fractions, alkoxylated alkylamine and the reaction products of glycols with fatty esters.

Glycerol monoesters useful as friction modifiers include, for example, glycerol esters of saturated or unsaturated $C_8$ to $C_{20}$ fatty acids such as glycerol monopalmitate, glycerol monostearate, glycerol monooleate, and the like.

Overbased carboxylates are known and are generally prepared by reacting an acidic material, normally an acidic gas such as $SO_2$ or $CO_2$, and most commonly carbon dioxide, with a mixture comprising a carboxylic acid and a stoichiometric excess of an alkaline base metal compound in a reaction medium, preferably with a promoter. The base metal is preferably an alkaline earth metal such as magnesium, calcium or barium in the form of an oxide or hydroxide. The carboxylic acid is preferably a saturated or unsaturated carboxylic acid having from about 8 to about 30 carbon atoms. Useful carboxylic acids include, but are not limited to, caprylic acid, capric acid, lauric acid, myristic acid, myristoleic acid, decanoic acid, dodecanoic acid, pentadecanoic acid, palmitic acid, palmitoleic acid, margaric acid, stearic acid, 12-hydroxystearic acid, oleic acid, ricinoleic acid, linoleic acid, arachidic acid, gadoleic acid, eicosadienoic acid, behenic acid, erucic acid, mixtures of any of these acids or their reactive equivalent.

Other suitable overbased carboxylates include overbased calcium tallate and overbased barium tallate.

A reaction product of TEA and fatty ester suitable for use as a friction modifier is the reaction product of TEA and methyl oleate. Other suitable friction modifiers include the reaction products of TEA with, for example, oleic acid, ricinoleic acid, isostearic acid, erucic acid, tall oil fatty acid (TOFA), mixed oleic/stearic acids, and iso-oleic acid.

Oxygenated petroleum fractions are known. Petroleum oxidates and methods for making them are disclosed in U.S. Pat. No. 5,439,602, which is herein incorporated by reference.

Also suitable for use as friction modifiers are the reaction products of thiodiglycol with fatty acids or fatty esters (e.g., oleic acid, methyl oleate, etc.), and the reaction products of a dialkylene glycol (e.g., diethylene glycol, dipropylene glycol, etc.) with a fatty acid or fatty ester (e.g., oleic acid, methyl oleate, etc.).

In another aspect of the invention it has been found that overbased alkaline earth sulfonate (especially crystalline overbased calcium sulfonate) provides a soluble oil composition with greater lubricity (i.e., lower coefficient of friction). Particularly preferred as a friction modifier are combinations of overbased calcium sulfonate and sulfurized olefin with 40% active sulfur like RC2540 (from Rhein-Chemie) possessing excellent lubricity and low sedimentation. A preferred crystalline overbased calcium sulfonate is available from Chemtura Corp. under the designation Calcinate C300CS and has a particle size of about 50-500 nm. Preferred particle size for a crystalline overbased calcium sulfonate ranges from about 50 nm to about 100 nm.

Furthermore, if necessary, various additives can be added to the soluble oil composition of the present invention, so long as the object of the present invention is not impaired. Examples of the additives include various known friction modifiers, oiliness agents, and extreme pressure agents such as alcohols, fatty acids, esters, diesters, polyvalent esters, fats and oils, sulfurized fats and oils, sulfurized esters, sulfurized olefins, chlorinated paraffins, phosphates, phosphites, dithiophosphates (zinc dithiophosphate, molybdenum dithiophosphate and the like), and dithiocarbamates (molybdenum dithiocarbamate and the like). In addition, various known anti-oxidant additives, surface active agents, and stabilizing agents.

Typical friction modifiers include fatty acid esters, fatty amide, fatty amides, ethoxylated fatty amine. Typical antioxidants are diphenyl amine and phenolic products like Naugalube 4381, Naugalube 640, Naugalube 438, Naugalube 531 and the like. Typical EP/AW additives include ZDDP, molybdenum dithiocarbamate compounds, chlorinate paraffins, sulfurized olefins, and sulfurized esters. These additives can be added in known and conventional amounts.

The following Examples illustrate features of the invention.

The examples were prepared with the overbased calcium sulfonates displayed in Table 1, the functional additives displayed in Table 2 and the soluble Oil Packages displayed in Table 3.

TABLE 1

| Overbased calcium sulfonates | | Calcinate C-300R | Calcinate C-400CLR | Calcinate C-300CS | Calcinate C-400W |
|---|---|---|---|---|---|
| Form | | amorph | amorph | cryst | cryst |
| Particle Size, nm | | 10-30 | 10-30 | 50-100 | 100-1000 |
| Calcium, wt % | ASTM D4951 | 12.0 | 15.2 | 10.5 | 14.5 |
| Calcium Sulfonate, wt % | ASTM D3712 | 28.0 | 18.5 | 18.5 | 17.6 |
| TBN, mgKOH/g | ASTM D2896 | 305 | 405 | 285 | 385 |
| Water, wt % | ASTM D95 | 0.3 | 0.3 | 0.2 | 0.5 |
| Viscosity @ 100° C., cSt | ASTM D445 | 75 | 75 | 100 | 40,000 |
| Flash Point, COC, ° C. | ASTM D92 | 220 | 220 | 220 | 220 |
| Specific Gravity @ 15° C. | ASTM D4052 | 1.13 | 1.2 | 1.1 | 1.15 |
| Color (dilute) | ASTM D1500 | 5 | 5 | 5 | 5 |
| Free Alkalinity, mgKOH/g | SAM 005 | 21 | 1 | 20 | — |

TABLE 2

| | |
|---|---|
| RC2540 | sulfurized olefin (40% sulfur) |
| Kloro 60-50 | chlorinated paraffin (50-60% chlorine) |
| OLOA 371 | ashless dispersant succinimide |
| OA/TEA | triester amine reaction product of triethanol amine and oleic acid |
| PIBSA | poly-isobutylene succinic anhydride (1050 MW) |
| Alox 165L | oxidized petrolatum |

TABLE 3

| |
|---|
| Soluble Oil Package #1 contains 0% neutralized tall oil |
| Soluble Oil Package #2 contains 12% neutralized tall oil |
| Soluble Oil Package #3 contains 15% neutralized tall oil |
| Soluble Oil Package #4 contains 23% neutralized tall oil |

Comparative Example 1 and Examples 2 and 3, as displayed in Table 4, demonstrate the effect of adding neutralized tall oil to an unstable blend of a soluble oil package and overbased sulfonate to form a metalworking emulsion. The sediment volume percent which precipitated in weeks 1-4 was recorded in Table 5.

TABLE 4

| | Examples | | |
|---|---|---|---|
| | Comp. Ex. 1 | Ex. 2 | Ex. 3 |
| Soluble Oil Package #1 | 25.0 | 24.4 | 23.8 |
| neutralized tall oil | 0.0 | 0.6 | 1.2 |
| Calcinate C-400CLR | 10.0 | 10.0 | 10.0 |
| 100SUS naphthenic oil | 65.0 | 65.0 | 65.0 |
| Total | 100 | 100 | 100 |
| Emulsion (90:10 in D.I. Water) | good | good | good |

TABLE 5

| Sediment (Vol %) (weeks) | Comp. Ex. 1 | Ex. 2 | Ex. 3 |
|---|---|---|---|
| 1 | 0 | 0.05 | 0 |
| 2 | 0.02 | 0.04 | 0.03 |
| 3 | 0.03 | 0.25 | 0.01 |
| 4 | 0.02 | 0.4 | 0.15 |
| Appearance of Walls | coated[1] | clean | clean |

[1]the sediment is low since the calcium carbonate has adhered to the wall of the centrifuge tube Comparative Example 1 demonstrates the effect of adding a soluble oil package to an overbased calcium sulfonate to form an emulsion. The resulting product precipitated calcium carbonate sediment as well as adhering calcium carbonate to the sides of the centrifuge tube.

Examples 2 demonstrates the effect of adding a soluble oil package and neutralized tall oil (3% in the package) to an overbased calcium sulfonate to form an emulsion. The tall oil acted to stabilize the overbased calcium sulfonate and prevent precipitation of calcium carbonate and reduced the amount of calcium carbonate adhered to the centrifuge tube.

Examples 3 demonstrates the effect of adding a soluble oil package and neutralized tall oil (5% in the package) to an overbased calcium sulfonate to form an emulsion. The tall oil acted to stabilize the overbased calcium sulfonate and prevent precipitation of calcium carbonate and reduced the amount of calcium carbonate adhered to the centrifuge tube.

Comparative Example 1 and Examples 4-15, as displayed in Tables 6A and 6B, respectively, demonstrated the effective combinations of tall oil, overbased sulfonate, particles size and free alkalinity to make a stable emulsion, where in a specific embodiment a combination of an amorphous overbased calcium sulfonate possessing a particle size of 10-30 nm and low free alkalinity with 12-15% neutralized tall oil in the soluble oil package is preferred. The sediment volume percent which precipitated in weeks 1-4 was recorded in Tables 6A and 6B.

TABLE 6A

| | Examples | | | | | | |
|---|---|---|---|---|---|---|---|
| | Comp. Ex. 1 | Ex. 4 | Ex. 5 | Ex. 6 | Ex. 7 | Ex. 8 | Ex. 9 |
| Package | | | | | | | |
| Soluble Oil Package #1 | 25 | | | | | | |
| Soluble Oil Package #2 | | 25 | 25 | 25 | 25 | | |
| Soluble Oil Package #3 | | | | | | 25 | 25 |
| Soluble Oil Package #4 | | | | | | | |
| 100 SUS naphthenic oil | 65 | 65 | 65 | 65 | 65 | 65 | 65 |
| Calcinate C-300CS | 10 | 10 | | | | 10 | |
| Calcinate C-400W | | | 10 | | | | 10 |
| Calcinate C-400CLR | | | | 10 | | | |
| Calcinate C-300R | | | | | 10 | | |
| Total | 100 | 100 | 100 | 100 | 100 | 100 | 100 |
| Soluble Oil Turbidity (NTU) | — | 1731 | 2427 | 8 | 8 | 850 | 2800 |
| Emulsion Quality (10:1 in D.I. Water) | good | good | good | good | good/neg. | good | good |
| Sediment (Vol %) (weeks) | | | | | | | |
| 1 | 0 | 0.15 | 0.15 | 0 | 0 | 0.01 | 2 |
| 2 | 0.02 | 0.30 | 0.25 | 0 | — | 0.05 | 2.5 |
| 3 | 0.03 | 0.50 | 0.35 | 0 | — | 0.10 | 2.9 |
| 4 | 0.02 | 0.4 | 0.35 | 0 | — | 0.15 | 2.9 |
| Appearance of Walls | coated[1] | clean | clean | clean | — | clean | clean |

[1]the sediment is low since the calcium carbonate has adhered to the wall of the centrifuge tube

TABLE 6B

| | Examples | | | | | |
|---|---|---|---|---|---|---|
| | Ex. 10 | Ex. 11 | Ex. 12 | Ex. 13 | Ex. 14 | Ex.15 |
| Package | | | | | | |
| Soluble Oil Package #1 | | | | | | |
| Soluble Oil Package #2 | | | | | | |
| Soluble Oil Package #3 | 25 | 25 | | | | |
| Soluble Oil Package #4 | | | 25 | 25 | 25 | 25 |
| 100 SUS naphthenic oil | 65 | 65 | 65 | 65 | 65 | 65 |
| Calcinate C-300CS | | | 10 | | | |
| Calcinate C-400W | | | | 10 | | |
| Calcinate C-400CLR | 10 | | | | 10 | |
| Calcinate C-300R | | 10 | | | | 10 |
| Total | 100 | 100 | 100 | 100 | 100 | 100 |
| Soluble Oil Turbidity (NTU) | 6 | 9 | 197 | 301 | 9 | 4 |
| Emulsion Quality (10:1 in D.I. Water) | good | poor | neg. | neg. | neg. | neg. |
| Sediment (Vol %) (weeks) | | | | | | |
| 1 | 0 | 0 | — | — | — | — |
| 2 | 0 | 0 | — | — | — | — |
| 3 | 0 | 0.02 | — | — | — | — |
| 4 | 0 | 0.02 | — | — | — | — |
| Appearance of Walls | clean | clean | — | — | — | — |

Example 4 demonstrated the effect of adding 50-100 nm particle sized crystalline high free alkalinity overbased calcium sulfonate to a soluble oil package containing 12% neutralized tall oil to make a stable emulsion with low sediment.

Example 5 demonstrated the effect of adding 100-1000 nm particle sized crystalline high free alkalinity overbased calcium sulfonate to a soluble oil package containing 12% neutralized tall oil to make a stable emulsion with low sediment.

Example 6 demonstrated the effect of adding 10-30 nm particle sized amorphous low free alkalinity overbased calcium sulfonate to a soluble oil package containing 12% neutralized tall oil to make a stable emulsion with no sediment.

Example 7 demonstrated the effect of adding 10-30 nm particle sized amorphous high free alkalinity overbased calcium sulfonate to a soluble oil package containing 12% neutralized tall oil to make an unstable emulsion which separates after 1 week (negative emulsion quality).

Example 8 demonstrated the effect of adding 50-100 nm particle sized crystalline high free alkalinity overbased calcium sulfonate to a soluble oil package containing 15% neutralized tall oil to make a stable emulsion with low sediment.

Example 9 demonstrated the effect of adding 100-1000 nm particle sized crystalline high free alkalinity overbased calcium sulfonate to a soluble oil package containing 15% neutralized tall oil to make a stable emulsion with high sediment.

Example 10 demonstrated the effect of adding 10-30 nm particle sized amorphous low free alkalinity overbased calcium sulfonate to a soluble oil package containing 15% neutralized tall oil to make a stable emulsion with no sediment.

Example 11 demonstrated the effect of adding 10-30 nm particle sized amorphous high free alkalinity overbased calcium sulfonate to a soluble oil package containing 15% neutralized tall oil to make a stable emulsion with no sediment.

Example 12 demonstrated the effect of adding 50-100 nm particle sized crystalline high free alkalinity overbased calcium sulfonate to a soluble oil package containing 23% neutralized tall oil to make an unstable emulsion.

Example 13 demonstrated the effect of adding 100-1000 nm particle sized crystalline high free alkalinity overbased calcium sulfonate to a soluble oil package containing 23% neutralized tall oil to make an unstable emulsion.

Example 14 demonstrated the effect of adding 10-30 nm particle sized amorphous low free alkalinity overbased calcium sulfonate to a soluble oil package containing 23% neutralized tall oil to make an unstable emulsion.

Example 15 demonstrated the effect of adding 10-30 nm particle sized amorphous high free alkalinity overbased calcium sulfonate to a soluble oil package containing 23% neutralized tall oil to make an unstable emulsion.

Examples 16-35, as displayed in Tables 8A and 8B, respectively, demonstrated the effect of adding functional additives to the soluble oil to make a stable emulsion for metalworking applications. The preferred embodiment is a combination of an amorphous overbased calcium sulfonate with a particle size of 10-30 nm and low free alkalinity with 12-15% neutralized tall oil in the soluble oil package and functional additives. The sediment volume percent which precipitated in weeks 1-4 was recorded in Tables 8A and 8B.

TABLE 8A

| | Examples | | | | | | | | |
|---|---|---|---|---|---|---|---|---|---|
| | Ex. 16 | Ex. 17 | Ex. 18 | Ex. 19 | Ex. 20 | Ex. 21 | Ex. 22 | Ex. 23 | Ex. 24 |
| Soluble Oil Package #3 | 25 | 25 | 25 | 25 | 25 | 25 | 25 | 25 | 25 |
| 100 SUS naphthenic oil | 65 | 64 | 64 | 64 | 64 | 65 | 64 | 64 | 64 |
| Overbased Calcium Sulfonates | | | | | | | | | |
| Calcinate C-400CLR | 10 | 10 | 10 | 10 | 10 | | | | |
| Calcinate C-300R | | | | | | 10 | 10 | 10 | 10 |
| Calcinate C-300CS | | | | | | | | | |
| Calcinate C-400W | | | | | | | | | |
| Functional Additives | | | | | | | | | |
| OLOA 371 | | 1 | | | | | 1 | | |
| OA/TEA | | | 1 | | | | | 1 | |
| PIBSA | | | | 1 | | | | | 1 |
| Alox 165L | | | | | 1 | | | | |
| Total | 100 | 100 | 100 | 100 | 100 | 100 | 100 | 100 | 100 |
| Soluble Oil Turbidity (NTU) | 6 | 6 | 6 | 6 | 5 | 5 | 4 | 5 | 5 |
| Emulsion (90:10 in D.I. Water) | | | | | | | | | |
| Quality | good | good | good | good | good | good/neg. | good/neg. | good/neg. | good/neg. |
| Oil (ml) | 0 | 0 | 0 | 0 | 0 | 0 | 0 | 0 | 0 |
| Cream (ml) | 4 | 4 | 4 | 2 | 4 | 0 | 20 | 32 | 0 |
| Sediment (Vol %) (weeks) | | | | | | | | | |
| 1 | 0.01 | 0 | 0 | 0 | 0 | 0 | — | — | 0 |
| 2 | 0.01 | 0 | 0 | 0 | 0 | — | — | — | — |
| 3 | 0.01 | 0 | 0 | 0 | 0 | — | — | — | — |
| 4 | 0.01 | 0 | 0 | 0.01 | 0 | — | — | — | — |

TABLE 8B

| | Examples | | | | | | | | | | |
|---|---|---|---|---|---|---|---|---|---|---|---|
| | Ex. 25 | Ex. 26 | Ex. 27 | Ex. 28 | Ex. 29 | Ex. 30 | Ex. 31 | Ex. 32 | Ex. 33 | Ex. 34 | Ex. 35 |
| Soluble Oil Package #3 | 25 | 25 | 25 | 25 | 25 | 25 | 25 | 25 | 25 | 25 | 25 |
| 100 SUS naphthenic oil | 64 | 65 | 64 | 64 | 64 | 64 | 65 | 64 | 64 | 64 | 64 |
| Overbased Calcium Sulfonates | | | | | | | | | | | |
| Calcinate C-400CLR | | | | | | | | | | | |
| Calcinate C-300R | 10 | | | | | | | | | | |
| Calcinate C-300CS | | 10 | 10 | 10 | 10 | 10 | | | | | |
| Calcinate C-400W | | | | | | | 10 | 10 | 10 | 10 | 10 |
| Functional Additives | | | | | | | | | | | |
| OLOA 371 | | | 1 | | | | | 1 | | | |
| OA/TEA | | | | 1 | | | | | 1 | | |
| PIBSA | | | | | 1 | | | | | 1 | |
| Alox 165L | 1 | | | | | 1 | | | | | 1 |
| Total | 100 | 100 | 100 | 100 | 100 | 100 | 100 | 100 | 100 | 100 | 100 |
| Soluble Oil Turbidity (NTU) | 5 | 663 | 1109 | 1332 | 40 | 616 | 1409 | 1666 | 1886 | 66 | 1280 |
| Emulsion (90:10 in D.I. Water) | | | | | | | | | | | |
| Quality | good/neg. | good | good | good | good | good | good | good | good | good | good |
| Oil (ml) | 0 | 0 | 0 | 0 | 0 | 0 | 0 | 0 | 0 | 0 | 0 |
| Cream (ml) | 0 | 0 | 0 | 0 | 0 | 0 | 0 | 0 | 0 | 0 | 0 |
| Sediment (Vol %) (weeks) | | | | | | | | | | | |
| 1 | 0 | 0.03 | 0.15 | 0.30 | 0.03 | 0.01 | 0.05 | 0.20 | 1.50 | 0.01 | 0.03 |
| 2 | 0.05 | 0.05 | 0.35 | 0.90 | 0.03 | 0.02 | 0.08 | 0.45 | 1.30 | 0.02 | 0.05 |
| 3 | — | 0.06 | 0.70 | 0.80 | 0.04 | 0.03 | 0.09 | 0.55 | 1.20 | 0.03 | 0.07 |
| 4 | — | 0.09 | 0.90 | 0.90 | 0.03 | 0.03 | 0.09 | 0.65 | 1.15 | 0.03 | 0.07 |

Example 16 demonstrated the effect of adding 10-30 nm particle sized amorphous low free alkalinity overbased calcium sulfonate to a soluble oil package containing 15% neutralized tall oil to make a stable emulsion with no sediment.

Example 17 demonstrated the effect of adding 10-30 nm particle sized amorphous low free alkalinity overbased calcium sulfonate to a soluble oil package containing 15% neutralized tall oil and the functional dispersant OLOA 371 to make a stable emulsion with no sediment.

Example 18 demonstrated the effect of adding 10-30 nm particle sized amorphous low free alkalinity overbased calcium sulfonate to a soluble oil package containing 15% neutralized tall oil and the functional friction modifier OA/TEA to make a stable emulsion with no sediment.

Example 19 demonstrated the effect of adding 10-30 nm particle sized amorphous low free alkalinity overbased calcium sulfonate to a soluble oil package containing 15% neutralized tall oil and the functional emulsifier PIBSA to make a stable emulsion with no sediment.

Example 20 demonstrated the effect of adding 10-30 nm particle sized amorphous low free alkalinity overbased calcium sulfonate to a soluble oil package containing 15% neutralized tall oil and the functional rust preventative Alox 165L to make a stable emulsion with no sediment.

Example 21 demonstrated the effect of adding 10-30 nm particle sized amorphous high free alkalinity overbased calcium sulfonate to a soluble oil package containing 15% neutralized tall oil to make an unstable emulsion which separates after 1 week.

Example 22 demonstrated the effect of adding 10-30 nm particle sized amorphous high free alkalinity overbased calcium sulfonate to a soluble oil package containing 15% neutralized tall oil and the functional dispersant OLOA 371 to make an unstable emulsion which separates after 1 day.

Example 23 demonstrated the effect of adding 10-30 nm particle sized amorphous high free alkalinity overbased calcium sulfonate to a soluble oil package containing 15% neutralized tall oil and the functional friction modifier OA/TEA to make an unstable emulsion separates after 1 day.

Example 24 demonstrated the effect of adding 10-30 nm particle sized amorphous high free alkalinity overbased calcium sulfonate to a soluble oil package containing 15% neutralized tall oil and the functional emulsifier PIBSA to make an unstable emulsion which separates after 1 week.

Example 25 demonstrated the effect of adding 10-30 nm particle sized amorphous high free alkalinity overbased calcium sulfonate to a soluble oil package containing 15% neutralized tall oil and the functional rust preventative Alox 165L to make an unstable which emulsion separates after 2 weeks.

Example 26 demonstrated the effect of adding 50-100 nm particle sized amorphous high free alkalinity overbased calcium sulfonate to a soluble oil package containing 15% neutralized tall oil to make a stable emulsion with low sediment.

Example 27 demonstrated the effect of adding 50-100 nm particle sized amorphous high free alkalinity overbased calcium sulfonate to a soluble oil package containing 15% neutralized tall oil and the functional dispersant OLOA 371 to make a stable emulsion with high sediment.

Example 28 demonstrated the effect of adding 50-100 nm particle sized amorphous high free alkalinity overbased calcium sulfonate to a soluble oil package containing 15% neutralized tall oil and the functional friction modifier OA/TEA to make a stable emulsion with high sediment.

Example 29 demonstrated the effect of adding 50-100 nm particle sized amorphous high free alkalinity overbased calcium sulfonate to a soluble oil package containing 15% neutralized tall oil and the functional emulsifier PIBSA to make a stable emulsion with low sediment.

Example 30 demonstrated the effect of adding 50-100 nm particle sized amorphous high free alkalinity overbased calcium sulfonate to a soluble oil package containing 15% neutralized tall oil and the functional rust preventative Alox 165L to make a stable emulsion with low sediment.

Example 31 demonstrated the effect of adding 100-1000 nm particle sized amorphous high free alkalinity overbased calcium sulfonate to a soluble oil package containing 15% neutralized tall oil to make a stable emulsion with low sediment.

Example 32 demonstrated the effect of adding 100-1000 nm particle sized amorphous high free alkalinity overbased calcium sulfonate to a soluble oil package containing 15% neutralized tall oil and the functional dispersant OLOA 371 to make a stable emulsion with high sediment.

Example 33 demonstrated the effect of adding 100-1000 nm particle sized amorphous high free alkalinity overbased calcium sulfonate to a soluble oil package containing 15% neutralized tall oil and the functional friction modifier OA/TEA to make a stable emulsion with high sediment.

Example 34 demonstrated the effect of adding 100-1000 nm particle sized amorphous high free alkalinity overbased calcium sulfonate to a soluble oil package containing 15% neutralized tall oil and the functional emulsifier PIBSA to make a stable emulsion with low sediment.

Example 35 demonstrated the effect of adding 100-1000 nm particle sized amorphous high free alkalinity overbased calcium sulfonate to a soluble oil package containing 15% neutralized tall oil and the functional rust preventative Alox 165L to make a stable emulsion with low sediment.

Examples 36-41, as displayed in Table 10 demonstrated the improved rust preventative properties of a soluble oil composition made with overbased calcium sulfonate and functional additives to make a stable emulsion for metalworking applications. According to one specific embodiment of the invention a combination of an amorphous overbased calcium sulfonate with a particle size of 10-30 nm and low free alkalinity with 12-15% neutralized tall oil in the soluble oil package and functional additives is presented.

TABLE 10

| | Examples | | | | | |
|---|---|---|---|---|---|---|
| | Ex. 36 | Ex. 37 | Ex. 38 | Ex. 39 | Ex. 40 | Ex. 41 |
| Soluble Oil Package #3 | 25 | 25 | 25 | 25 | 25 | 25 |
| 100 SUS naphthenic oil | 75 | 65 | 64 | 64 | 64 | 64 |
| Calcinate C-400CLR | | 10 | 10 | 10 | 10 | 10 |
| OLOA 371 | | | 1 | | | |
| OA/TEA | | | | 1 | | |
| PIBSA | | | | | 1 | |
| Alox 165L | | | | | | 1 |
| Total | 100 | 100 | 100 | 100 | 100 | 100 |
| Soluble Oil Turbidity (NTU) | — | 6 | 6 | 6 | 6 | 5 |
| Emulsion (90:10 in D.I. Water) | | | | | | |
| Quality | good | good | good | good | good | good |
| Oil (ml) | 0 | 0 | 0 | 0 | 0 | 0 |
| Cream (ml) | 0 | 4 | 4 | 4 | 2 | 4 |

TABLE 10-continued

| | Examples | | | | | |
|---|---|---|---|---|---|---|
| | Ex. 36 | Ex. 37 | Ex. 38 | Ex. 39 | Ex. 40 | Ex. 41 |
| Sediment (Vol %) (weeks) | | | | | | |
| 1 | 0 | 0.01 | 0 | 0 | 0 | 0 |
| 2 | 0 | 0.01 | 0 | 0 | 0 | 0 |
| 3 | 0 | 0.01 | 0 | 0 | 0 | 0 |
| 4 | 0 | 0.01 | 0 | 0 | 0.01 | 0 |
| Iron Chip Rust Test (2 g Fe/20 min soak/16 hr.) | | | | | | |
| 10% | Pass | Pass | Pass | Pass | Pass | Pass |
| 5.0% | Pass | Pass | Pass | Pass | Pass | Pass |
| 2.5% | Fail | Pass | Pass | Pass | Pass | Pass |
| 1.0% | Fail | Fail | Fail | Fail | Fail | Fail |

Example 36 demonstrated the baseline rust preventatives properties of a soluble oil package, where up to 5% treat is required to pass the iron chip test.

Example 37 demonstrated the effect of adding 10-30 nm particle sized amorphous low free alkalinity overbased calcium sulfonate to a soluble oil package containing 15% neutralized tall oil to make a stable emulsion with no sediment which prevents rust at 2.5% concentration.

Example 38 demonstrated the effect of adding 10-30 nm particle sized amorphous low free alkalinity overbased calcium sulfonate to a soluble oil package containing 15% neutralized tall oil and the functional dispersant OLOA 371 to make a stable emulsion with no sediment which prevents rust at 2.5% concentration.

Example 39 demonstrated the effect of adding 10-30 nm particle sized amorphous low free alkalinity overbased calcium sulfonate to a soluble oil package containing 15% neutralized tall oil and the functional friction modifier OA/TEA to make a stable emulsion with no sediment which prevents rust at 2.5% concentration.

Example 40 demonstrated the effect of adding 10-30 nm particle sized amorphous low free alkalinity overbased calcium sulfonate to a soluble oil package containing 15% neutralized tall oil and the functional emulsifier PIBSA to make a stable emulsion with no sediment which prevents rust at 2.5% concentration.

Example 41 demonstrated the effect of adding 10-30 nm particle sized amorphous low free alkalinity overbased calcium sulfonate to a soluble oil package containing 15% neutralized tall oil and the functional rust preventative Alox 165L to make a stable emulsion with no sediment which prevents rust at 2.5% concentration.

Examples 42-48, as displayed in Table 11, demonstrated the improved EP/AW properties of a soluble made with overbased calcium sulfonate and functional additives to make a stable emulsion for metalworking applications. In one specific embodiment of the invention a combination of an amorphous overbased calcium sulfonate with a particle size of 10-30 nm and low free alkalinity with 12-15% neutralized tall oil in the soluble oil package and sulfurized olefin is presented.

TABLE 11

| | Examples | | | | | | |
|---|---|---|---|---|---|---|---|
| | Ex. 42 | Ex. 43 | Ex. 44 | Ex. 45 | Ex. 46 | Ex. 47 | Ex. 48 |
| Kloro 60-50 | | 10 | | | | | |
| Calcinate C-400CLR | | | 10 | | | 5 | |
| Calcinate C-300CS | | | | 10 | | | 5 |
| RC2540 | | | | | 10 | 5 | 5 |
| Soluble Oil Package #3 | 25 | 25 | 25 | 25 | 25 | 25 | 25 |
| 100 SUS naphthenic oil | 75 | 65 | 65 | 65 | 65 | 65 | 65 |
| Soluble Oil Appearance | B&C | B&C | B&C | hazy/sed. | B&C | B&C | hazy/sed. |
| Emulsion Quality | | | | | | | |
| 1 week | good | good | good | good | good | good | good |
| 2 week | good | good | good | good | good | good | good |
| 3 week | good | good | good | good | good | good | good |
| 4 week | good | good | good | good | good | good | good |
| Sediment | | | | | | | |
| 1 week | 0 | 0 | 0 | 0.9 | 0 | 0.04 | 0.4 |
| 2 week | 0 | 0 | 0 | 0.85 | 0 | 0.03 | 0.4 |
| 3 week | 0 | 0 | 0 | 0.9 | 0 | 0.02 | 0.4 |
| 4 week | 0 | 0 | 0 | 1.0 | 0 | 0.02 | 0.4 |

TABLE 11-continued

| | Examples | | | | | | |
|---|---|---|---|---|---|---|---|
| | Ex. 42 | Ex. 43 | Ex. 44 | Ex. 45 | Ex. 46 | Ex. 47 | Ex. 48 |
| ASTM D-2783 | | | | | | | |
| Load-Wear Index, kgf | 28.1 | 19.3 | 23.3 | 30.0 | 24.3 | 23.6 | 23.2 |
| Weld Point, kg | 100 | 100 | 100 | 126 | 100 | 100 | 100 |
| ASTM D3233A | | | | | | | |
| True Load, lbs. | 1438 | 1934 | 923 | 2357 | 2919 | 3558 | — |

Example 42 demonstrated the baseline EP/AW properties of a soluble oil package in ASTM D2783 Four Ball EP and ASTM D 3233 Falex Pin and Vee Block testing.

Example 43 demonstrated the baseline EP/AW properties of a soluble oil package containing a chlorinated paraffin (50-60% chlorine) EP/AW additives in ASTM D2783 and ASTM D3233 testing.

Example 44 demonstrated the effect of adding 10-30 nm particle sized amorphous low free alkalinity overbased calcium sulfonate to a soluble oil package containing 15% neutralized tall oil to make a stable emulsion with no sediment which provides adequate EP/AW protection.

Example 45 demonstrated the effect of adding 50-100 nm particle sized amorphous high free alkalinity overbased calcium sulfonate to a soluble oil package containing 15% neutralized tall oil to make a stable emulsion with low sediment and improved EP/AW properties.

Example 46 demonstrated the baseline EP/AW properties of a soluble oil package containing a sulfurized olefin (40% active sulfur) EP/AW additives in ASTM D2783 and ASTM D3233 testing.

Example 47 demonstrated the effect of adding 10-30 nm particle sized amorphous low free alkalinity overbased calcium sulfonate in combination with sulfurized olefin to a soluble oil package containing 15% neutralized tall oil to make a stable emulsion with no sediment which provides excellent EP/AW protection.

Example 48 demonstrated the effect of adding 50-100 nm particle sized amorphous high free alkalinity overbased calcium sulfonate in combination with sulfurized olefin to a soluble oil package containing 15% neutralized tall oil to make a stable emulsion with low sediment and EP/AW properties.

Examples 49-53, as displayed in Table 12, demonstrated the stability of a soluble made with overbased calcium sulfonate and sulfurized olefin to make a stable emulsion for metalworking applications. In a specific embodiment of the invention a combination of an amorphous overbased calcium sulfonate with a particle size of 10-30 nm (5% or less) and low free alkalinity with 12-15% neutralized tall oil in the soluble oil package and sulfurized olefin (20% or less) is presented.

TABLE 12

| | Examples | | | | |
|---|---|---|---|---|---|
| | Ex. 49 | Ex. 50 | Ex. 51 | Ex. 52 | Ex. 53 |
| Calcinate C-400CLR | | 5 | | 5 | 10 |
| RC 2540 | | | 20 | 20 | 20 |
| Soluble Oil Package #3 | 20 | 20 | 20 | 20 | 20 |

TABLE 12-continued

| | Examples | | | | |
|---|---|---|---|---|---|
| | Ex. 49 | Ex. 50 | Ex. 51 | Ex. 52 | Ex. 53 |
| 100 SUS naphthenic oil | 80 | 75 | 60 | 55 | 50 |
| Total | 100 | 100 | 100 | 100 | 100 |
| Soluble Oil Appearance | | | | | |
| 1 hour | B&C | B&C | B&C | B&C | B&C |
| 1 day | B&C | B&C | B&C | B&C | B&C |
| 4 week | B&C | B&C | B&C | B&C | B&C |
| Emulsion Quality | | | | | |
| 1 hour | good | good | good | good | neg.[1] |
| 1 day | good | good | good | good | good[2] |
| 4 weeks | good | good | good | good - oil ring | neg.[3] |

[1]this was negative, but after 24 hours the emulsion could be reshaken to emulsify

[2]although there was no sediment there was calcium carbonate adhered to the walls of the centrifuge tube

[3]although there was no sediment there was oil and calcium carbonate adhered to the walls of the centrifuge tube Example 49 demonstrated the baseline stability of the soluble oil and emulsion formed from a soluble oil package containing 15% neutralized tall oil 10-30 nm particle sized amorphous low free alkalinity overbased calcium sulfonate.

Example 50 demonstrated the baseline stability of the soluble oil and emulsion formed from a soluble oil package containing 15% neutralized tall oil and 10-30 nm particle sized amorphous low free alkalinity overbased calcium sulfonate.

Example 51 demonstrated the baseline stability of the soluble oil and emulsion formed from a soluble oil package containing 15% neutralized tall oil and sulfurized olefin (40% active sulfur).

Example 52 demonstrated the effect of adding low amounts (5% or less) of 10-30 nm particle sized amorphous low free alkalinity overbased calcium sulfonate in combination with sulfurized olefin to a soluble oil package containing 15% neutralized tall oil to make a bright and clear (B&C) soluble oil which forms a stable emulsion with no sediment.

Example 53 demonstrated the effect of adding high amounts (10% or more) of 10-30 nm particle sized amorphous low free alkalinity overbased calcium sulfonate in combination with sulfurized olefin to a soluble oil package containing 15% neutralized tall oil to make a bright and clear (B&C) soluble oil which forms an unstable emulsion with sediment adhered to the walls of the centrifuge tube.

While the process of the invention has been described with reference to certain embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the process of the invention but that the invention will include all embodiments falling within the scope of the appended claims.

What is claimed is:

1. A soluble oil composition which consists essentially of:

a) a base oil selected from the group consisting of naphthenic oil; hydrogenated polyolefin oils; poly-alpha-olefins; alkyl esters of dicarboxylic acids; complex esters of dicarboxylic acids; polyglycol and alcohol; alkyl esters of carbonic or phosphoric acids; polysilicones; fluorohydrocarbon oils; homo- and inter-polymers of $C_2$-$C_{12}$ olefins; carboxylic acid esters of both monoalcohols and polyols; polyethers; silicones; polyglycols; silicates, alkylated aromatics; carbonates; thiocarbonates; orthoformates; phosphates; phosphites; borates; and halogenated hydrocarbons b) an emulsion stabilizing amount of a neutralized carboxylic acid obtained from tall oil and/or component thereof; and c) from 1 to 10 weight percent of at least one overbased calcium sulfonate; and, optionally, d) at least one additive selected from the group consisting of extreme pressure agent, anti-wear agent, emulsifying agent, rust preventive, corrosion inhibitor, anti-foaming agent, anti-oxidant additives, surface active agents, friction modifier, stabilizing agents, and mixtures thereof.

2. The soluble oil composition of claim 1 wherein the base oil is at least one selected from the group consisting of esters of dicarboxylic acids, dibutyl adipate, di(2-ethylhexyl)adipate, didodecyl adipate, di(tridecyl)adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl)sebacate, and the 2-ethylhexyl diester of linoleic acid dimer.

3. The soluble oil composition of claim 1 wherein the neutralized carboxylic acid is at least one obtained from the group consisting of tall oil fatty acids, tall oil fatty acids containing less than about 2% rosin and tall oil rosin.

4. The soluble oil composition of claim 1 wherein the amount of neutralized carboxylic acid ranges from about 5 weight percent to about 23 weight percent of the soluble oil composition.

5. The soluble oil composition of claim 1 wherein the amount of neutralized carboxylic acid ranges from about 12 to about 15 weight percent of the soluble oil composition.

6. The soluble oil composition of claim 1 wherein the amount of neutralized tall oil ranges from about 5 to about 23 weight percent of the soluble oil composition.

7. The soluble oil composition of claim 6 wherein the amount of neutralized tall oil ranges from about 12 to about 15 weight percent of the soluble oil composition.

8. The soluble oil composition of claim 1 wherein the amount of overbased calcium sulfonate ranges from about 2 to about 5 weight percent of the soluble oil composition.

9. The soluble oil composition of claim 1 wherein the total base number of the overbased calcium sulfonate is at least about 400.

10. The soluble oil composition of claim 1 wherein the total base number of the overbased calcium sulfonate is from about 200 to about 400.

11. The soluble oil composition of claim 1 wherein the total base number of the overbased calcium sulfonate is from about 250 to about 350.

12. The soluble oil composition of claim 1 wherein the friction modifier is at least one selected from the group consisting of glycerol monoesters, overbased carboxylates, overbased tall oil fatty acids, triethanolamine, diethanolamine, glycol, oleic acid, ricinoleic acid, isostearic acid, erucic acid, tall oil fatty acid (TOFA), mixed oleic/stearic acids, and isooleic acid.

13. The soluble oil composition of claim 1 wherein the anti-wear agent is sulfurized olefin.

14. The soluble oil composition of claim 1 wherein the at least one additive is a phenolic compound.

* * * * *